US007125483B2

(12) United States Patent
Haynal

(10) Patent No.: US 7,125,483 B2
(45) Date of Patent: Oct. 24, 2006

(54) CORROSION CONTROL IN OLEFIN PRODUCTION PLANTS

(75) Inventor: Robert J. Haynal, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 544 days.

(21) Appl. No.: 10/411,183

(22) Filed: Apr. 10, 2003

(65) Prior Publication Data

US 2004/0200756 A1 Oct. 14, 2004

(51) Int. Cl.
*C07C 7/00* (2006.01)
*C10G 7/10* (2006.01)

(52) U.S. Cl. ..... 208/47; 208/48 AA; 208/55; 208/228; 208/299; 252/394; 422/12; 507/241; 507/243; 507/244; 585/804

(58) Field of Classification Search ..... 208/228, 208/299, 55, 48 AA, 47; 252/394; 422/12; 507/241, 243, 244; 585/804
See application file for complete search history.

(56) References Cited

U.S. PATENT DOCUMENTS

| | | | | | |
|---|---|---|---|---|---|
| 2,621,216 | A * | 12/1952 | White | ..... | 585/636 |
| 2,938,851 | A * | 5/1960 | Stedman et al. | ..... | 208/47 |
| 4,756,820 | A * | 7/1988 | Reid et al. | ..... | 208/48 AA |
| 4,900,458 | A * | 2/1990 | Schroeder et al. | ..... | 507/243 |
| 5,322,630 | A * | 6/1994 | Williams et al. | ..... | 507/241 |
| 5,446,229 | A * | 8/1995 | Taylor et al. | ..... | 585/648 |
| 5,556,575 | A * | 9/1996 | Babaian-Kibala et al. | .. | 252/394 |
| 6,303,079 | B1 * | 10/2001 | Meyer | ..... | 422/12 |

* cited by examiner

*Primary Examiner*—Glenn Caldarola
*Assistant Examiner*—Prem C. Singh
(74) *Attorney, Agent, or Firm*—Roderick W. MacDonald

(57) ABSTRACT

A method for reducing acid corrosion and products of acid corrosion in a thermal cracking plant, the acid corrosion products being compounds of iron, chromium, nickel, lead, cadmium, manganese, mercury, magnesium, calcium, sodium, copper, zinc, lead, molybdenum, and aluminum, the improvement comprising introducing ethylene diamine into at least one process stream of the plant.

12 Claims, No Drawings

CORROSION CONTROL IN OLEFIN PRODUCTION PLANTS

BACKGROUND OF THE INVENTION

1. Field of the Invention

This invention relates to the control of corrosion and corrosion products in an olefins production plant that employs a hydrocarbon cracking process such as steam cracking in a pyrolysis furnace.

2. Description of the Prior Art

Thermal cracking of hydrocarbons is a petrochemical process that is widely used to produce olefins such as ethylene, propylene, butenes, butadiene, and aromatics such as benzene, toluene, and xylenes.

This process is carried out in a pyrolysis furnace (steam cracker) at pressures in the reaction zone of from about 10 psig to about 30 psig. Pyrolysis furnaces have internally thereof a convection section and a radiant section. Preheating is accomplished in the convection section, while cracking occurs in the radiant section.

Basically, a hydrocarbon feedstock such as naphtha, gas oil or other fractions of whole crude oil, is mixed with steam which serves as a diluent to keep the hydrocarbon molecules separated. The steam/hydrocarbon mixture is preheated in the convection section of the cracking furnace to from about 900° F. to about 1,000° F., then enters the reaction zone (the radiant section of a cracking furnace) where it is very quickly heated to a hydrocarbon cracking temperature in the range of from about 1,450° F. to about 1,550° F.

After severe cracking, the effluent from the pyrolysis furnace contains gaseous hydrocarbons of great variety, e.g., from one to thirty-five carbon atoms per molecule. These gaseous hydrocarbons can be saturated, monounsaturated, and polyunsaturated, and can be aliphatic and/or aromatic. The cracked gas also contains significant amounts of molecular hydrogen.

Thus, conventional steam cracking, as carried out in a commercial olefin production plant (olefin plant), employs a fraction of whole crude oil and totally vaporizes that fraction while thermally cracking same. The cracked product can contain, for example, about 1 weight percent (wt. %) molecular hydrogen, about 10 wt. % methane, about 25 wt. % ethylene, and about 17 wt. % propylene, all wt. % being based on the total weight of the cracked product, with the remainder consisting mostly of other hydrocarbon molecules having from 4 to 35 carbon atoms per molecule.

The cracked product is then processed in the olefin plant to produce, as products of the plant, various separate individual streams of high purity such as molecular hydrogen, ethylene, propylene, mixed hydrocarbons having four carbon atoms per molecule, and pyrolysis gasoline. Each separate individual stream aforesaid is a valuable commercial product in its own right.

Thus, an olefin plant takes a part (fraction) of a whole crude oil stream and, through complex and thorough processing of same, generates a plurality of separate, valuable products therefrom.

In addition to these valuable products, the pyrolysis process can produce small amounts of undesirable byproducts which can cause deleterious effects to the process, plant equipment, or both.

One class of chemicals in this category is acids, both organic and inorganic. For various reasons and purposes, acids are introduced into the process, or are made in the process itself, or otherwise find their way into various process streams within an olefin plant. They can cause corrosion problems since the equipment and piping in an olefin plant is largely composed of carbon steel.

For example, acetic acid can be found in various streams in an olefin plant. The acetic acid reacts with iron in carbon steel pipe and equipment thus forming iron acetate and causing corrosion of the carbon steel. The iron acetate is relatively stable and moves on in the olefin plant without causing further damage to the plant until it encounters some oxygen, for example as found in some pyrolysis gasoline (pygas) streams, particularly mixed pygas and $C_5$ streams from an olefin plant that cracks light hydrocarbon feeds. When the iron acetate encounters molecular oxygen, the oxygen destabilizes the iron acetate and breaks it down to ferric oxide and acetic acid, thereby releasing fresh acetic acid to cause additional corrosion in other parts of the olefin plant that are formed of carbon steel by forming more iron acetate. Such a corrosion-acid regeneration-corrosion cycle can go on in many locations throughout an olefin plant.

Iron acetate, for example, dissolves in either a water phase it encounters, or a hydrocarbon phase, or both phases if present. Thus, it will find oxygen in any phase by which to generate fresh acetic acid for additional iron corrosion.

It is desirable to neutralize acids that are coursing through an olefin plant. This is not an easy task.

Many salts can be made of the acids to neutralize same, but it is difficult to find one that will be stable under the various conditions existing in an olefin plant. For example, ammonia could be used to neutralize the aforesaid acetic acid, but ammonium acetate, although more stable than iron acetate in the presence of oxygen still breaks down under certain thermal conditions or certain acidic conditions to free up fresh acetic acid. Under basic conditions ammonia is generated. None of this is desirable in an olefin plant.

Thus, it is highly desirable to have a means by which acids can be neutralized in a stable manner under the varying conditions found in an olefin plant and that will not adversely affect operations in the olefin plant.

SUMMARY OF THE INVENTION

By this invention, an additive has been found that neutralizes a wide variety of acids found in an olefin plant, and does so by reacting with the acid to form a compound, e.g., a salt, that remains stable under the varying olefin plant operating conditions.

But this is not all. The additive of this invention enjoys substantial operating leverage in that one mole of the additive can tie up (neutralize) multiple moles of acid.

In addition, the additive of this invention not only neutralizes active acids in a leveraged fashion, but once it has done so, continues to clean up the olefin plant stream it is in by chelating with already formed corrosion products such as iron oxide.

The additive of this invention and the product it produces from reacting with an acid favor dissolving in water phases, when present, over dissolving in organic phases. The water phases are where the acids tend to collect. Thus, this additive goes where the acids are, and raises the pH of water systems in an olefin plant towards neutral, which is favorable for the plant, while lowering the corrosivity and corrosion products thereof in a stable manner.

The additive also allows for the presence of oxygen containing streams in an olefin plant without the need for deoxygenating those streams.

The additive of this invention is ethylenediame (1, 2ethylenediamine), hereafter EDA.

EDA is an amine useful by itself under olefin plant operating conditions. Other amines tend to stay dissolved in organic (hydrocarbon) phases, and can cause operating problems in other areas of an olefin plant whereas EDA does not.

Thus, this invention prevents new corrosion in an olefin plant environment and, at the same time, cleans up existing corrosion residue.

DETAILED DESCRIPTION OF THE INVENTION

In accordance with this invention, essentially any location in an olefin production plant wherein one or more processing streams (aqueous, organic or a mixture thereof) in that location contain an undesired organic and/or inorganic acid and/or one or more corrosion product (residue) from an organic and/or inorganic acid can be treated with EDA to neutralize such acid(s) and tie up by chelation such corrosion product(s).

By use of the terms "processing streams," "stream," or "streams" herein, what is meant is a fluid (liquid or mixture of liquid and gas) that is in use anywhere within an olefin production plant and its related processing units such as solvent extraction units. The stream could be encountered flowing through a pipe or other conduit within the plant or a piece of plant equipment, or it could be a temporarily non-flowing body of fluid in a holding tank or other vessel within the plant.

The acids found in streams within an olefin plant vary widely, and are generally an organic or inorganic acid or a mixture thereof in the same stream. Generally, most any inorganic acid or any organic acid having carboxylic functionality (—COOH) normally found in an olefin plant can be treated in accordance with this invention. Examples of such acids include acetic, formic, propionic, oxalic, isobutyric, carbonic, sulfurous, sulfuric, hydrochloric, nitrous, hydrofluoric, nitric, and benzoic. Such acids are normally present individually and/or in a mixture of 2 or more thereof in amounts of from about 1 to about 5,000 parts per million (ppm).

The products of corrosion are also found in streams throughout an olefin plant in widely varying amounts, but generally from about 2 to about 2,000 ppm. Such products can be compounds of metals originally picked up in the acid corrosion process. For example, iron is picked up from a carbon steel pipe by acetic acid and forms iron acetate, which then breaks down in the presence of oxygen to yield a ferric oxide corrosion product. Such products can also be metal compounds from various sources within the plant, e.g., catalyst beds. Therefore the term "corrosion products" or "residue" in this invention is meant to be viewed broadly as unwanted or undesirable metal compounds dispersed in an olefin plant stream that are desirably removed from that stream. As such, a wide variety of metals are covered. Examples include iron, chromium, nickel, lead, cadmium, manganese, mercury, magnesium, calcium, sodium, copper, zinc, palladium, molybdenum, and aluminum to name but a few. The compounds representing metal compound corrosion products removed by this invention also vary widely, but are generally oxides, nitrates, sulfates, carbonates, and sulfides of such metals.

EDA when employed in a stream in an olefin plant pursuant to this invention reacts with and neutralizes any acid in that stream under the normal operating conditions of temperature and pressure that are present in that stream, e.g., from about 50° F. to about 300° F. at a pressure of from about 1 psig to about 300 psig. Such an employment reduces, for example, the corrosive capability of a stream containing acetic acid by tying up that acid in a non-corrosive salt (ethylenediaminetetraacetic acid, hereafter EDTA). The EDTA salt is stable under most olefin plant operating conditions. Thus, the corrosive tendency of an olefin plant stream is reduced by the formation of EDTA therein.

EDA as used in this invention has a very leveraging advantage in that EDA enjoys a favorable molar ratio in respect of most acids. For example, in the case of acetic acid, EDA has a 4 to 1 favorable molar ratio in that 1 mole of EDA will react with, and, therefore, remove the corrosive capability of, 4 moles of acetic acid. Similar molar advantages of EDA with respect to other specific acids will be obvious to those skilled in the art.

EDA is employed in a stream pursuant to this invention in an amount effective to neutralize at least part of the acid or acids present in that stream. Accordingly, the amount of EDA used will vary widely, but, generally, it will be used in an amount of from about 10 parts per billion to about 10 weight percent based on the total weight of the stream being treated, preferably from about 100 ppb to about 1 weight percent based on the total weight of the stream.

EDA, being a colorless liquid with a boiling point of 116° C., can be injected directly into a stream to be treated. EDA can also first be dispersed in a carrier solvent such as a gasoline cut, naphtha, a diesel cut, kerosene, and/or isooctane, and then introduced into a stream to be treated.

EDTA has a significant advantage in systems that contain both water and one or more hydrocarbons. EDA is more soluble in the hydrocarbon phase than the water phase of such a system. When EDA reacts with an acid, e.g., acetic acid and forms EDTA, the EDTA product is more soluble in the water phase than the hydrocarbon phase of that same system. This invention thus effectively removes the acid or acids it neutralizes from the hydrocarbon phase of a hydrocarbon/water system by forming a reaction product with such acids which follows the water phase and not the hydrocarbon phase.

EDTA readily forms chelate complexes with corrosion products found in olefin plant streams, and does so under the normal operating conditions of temperature and pressure of such streams.

EDTA is a ligand that can bind to a metal ion through more than one ligand atom, and, therefore is called a multidentate or chelating ligand. In EDTA the nitrogen atoms and carboxylate oxygen atoms are the potential ligand atoms in the molecule. When these atoms bind to a metal ion, the ligand atoms lose their protons. Multidentate ligands form strong metal complexes, stronger than those formed by monodentate ligands for example. Multidentate ligands thus form more stable metal complexes, which stability is mainly an entropy effect. EDTA is a ligand that can occupy all six coordination sites about a metal ion thereby tying up that metal ion in a stable configuration and removing that metal from free flow within the stream in which it resides. EDTA thus forms strong 1:1 complexes with many metal ions using 1 mole of EDTA for 1 mole of metal ion.

In many complexes EDTA completely engulfs the metal ion thereby removing the ion from the stream when the EDTA chelation complex is removed. In this mode the EDTA/metal complex forms a six-coordinate species where the two nitrogen atoms occupy adjacent positions of an octahedrally coordinated metal ion. The other four positions are occupied by carboxyl oxygen atoms.

EDTA will chelate with various metals in certain pH environments as is known in the art and present in an olefin plant. The pH range is broad, from a pH of 2 for the ferric ion to a pH of 10 for magnesium with a valence of plus two, to with ions of mercury, nickel, copper, lead, zinc, aluminum, cobalt, ferrous iron, manganese, and calcium falling within the pH range of from about 2 to about 10.

The EDTA/metal corrosion product residue complex, once formed can readily be physically separated from the parent carrier steam being treated. The complex precipitates out of its carrier stream and will accumulate in low spots in the system. At these spots the accumulation of complexes can be removed from the system by way of drains or a variety of mechanical means known in the art.

The complexes, once removed from the system, can be disassociated in known manner to free up the metal ion for recovery separate from the EDTA. The dissociation of the complex into EDTA and free metal ion is analogous to the dissociation of a weak acid into a proton and its associated anion.

Although not knowing to a certainty, and, therefore, not desiring to be bound thereby, it is presently thought that corrosive acids are formed, at least in part, in a hydrocarbon pyrolysis furnace through a mechanism of oxygen containing compound to ketene to acid. Oxygen containing compounds (oxygenates) can be routinely formed in or otherwise introduced into a pyrolysis furnace. For example, oxygen in a furnace can react with a hydrocarbon in the furnace to form an oxygenate, while other oxygenates are present as contaminants in the feed to the furnace. It is believed that at least certain of these oxygenates break down under the operating conditions of the furnace and form ketenes. Ketenes are compounds that contain carbon linked by one double bond to an oxygen atom and by another double bond to a carbon atom (RCCO, where R is hydrogen or a hydrocarbon radical). These ketenes then form an acid or acids that cause the corrosion problems aforesaid. As a specific example, acetone is a common contaminant in a hydrocarbon cracking feed for a pyrolysis furnace. Pursuant to the above intermediate ketene mechanism, at least part of the acetone present in the feed cracks under the operating conditions of the furnace to form methane and ketene ($CH_2CO$), and the ketene is then hydrolyzed to acetic acid.

EXAMPLE

A pygas stream containing about 45 weight percent (wt. %) aliphatic's, monooelfins and diolefins having from 4 to 11 carbon atoms per molecule, about 55 wt. % aromatics (benzene, toluene, xylenes, and styrene), about 10 ppm mole acetic acid, about 10 ppm mole molecular oxygen, and about 10 ppm mole ferric oxide is produced within an olefin production plant. This pygas stream is mixed with 3 ppm mole ethylene diamine at about 100° F. and 25 psig.

Within a few minutes the thus treated pygas stream is neutralized as to its acetic acid content, and an EDTA complex with the ferric oxide content of the pygas stream has formed and settled out of that stream, thereby rendering both the acetic acid and ferric oxide content of that stream in a condition for ready physical separation of the complex precipitate containing same from that stream.

This renders the stream essentially free of acetic acid and iron oxide corrosion residue.

I claim:

1. In a method for reducing at least one of acid corrosion and products of acid corrosion in a thermal cracking ethylene production plant wherein said corrosion products are compounds of at least one metal of the group consisting essentially of iron, chromium, nickel, lead, cadmium, manganese, mercury, magnesium, calcium, sodium, copper, zinc, palladium, molybdenum, and aluminum, the improvement comprising introducing into at least one process stream in an olefin processing unit ethylenediamine in an amount sufficient to reduce said acid corrosion and remove at least one said products of acid corrosion.

2. The method of claim 1 wherein said acid corrosion and said acid corrosion products are caused by at least one organic and inorganic acid chemically reacting with a physical part of said plant.

3. The method of claim 1 wherein said acid is at least one of acetic, formic, oxalic, propionic, isobutyric, carbonic, sulfurous, sulfuric, hydrochloric, hydrofluoric, nitric, nitrous, and benzoic.

4. The method of claim 1 wherein said at least one acid is present in said at least one stream in an amount of from about 1 to about 5,000 parts per million.

5. The method of claim 1 wherein said at least one acid is employed in said at least one stream under the normal operating conditions of temperature and pressure for that stream in said plant.

6. The method of claim 1 wherein said compound is at least one of the oxide, nitrate, sulfate, carbonate, and sulfide of said at least one metal.

7. The method of claim 1 wherein said ethylenediamine is introduced in an amount effective to neutralize at least some of said acid in said at least one stream.

8. The method of claim 7 wherein said amount is from about 10 parts per billion to about 10 weight percent based on the total weight of the stream being treated.

9. The method of claim 1 wherein said ethylenediamine is injected directly into said at least one stream to be treated.

10. The method of claim 1 wherein said ethylenediamine is dispersed in a carrier fluid and the carrier fluid containing the ethylenediamine is injected into said at least one stream to be treated.

11. The method of claim 10 wherein said carrier fluid is a hydrocarbon.

12. The method of claim 11 wherein said hydrocarbon is one of isooctane, naphtha, diesel, and gasoline.

* * * * *